United States Patent [19]

Meyer

[11] 4,271,341

[45] Jun. 2, 1981

[54] CIRCUIT BREAKER OPERATING MECHANISM

[75] Inventor: Thomas N. Meyer, Murrysville, Pa.

[73] Assignee: Westinghouse Electric Corp., Pittsburgh, Pa.

[21] Appl. No.: 945,369

[22] Filed: Sep. 25, 1978

Related U.S. Application Data

[63] Continuation of Ser. No. 762,542, Jan. 26, 1977, abandoned.

[51] Int. Cl.[3] ..... H01H 33/88

[52] U.S. Cl. ..... 200/148 A; 200/82 B; 60/634

[58] Field of Search ..... 200/82 B, 150 R, 144 R, 200/148 R, 148 A; 60/634

[56] References Cited

U.S. PATENT DOCUMENTS

| | | | |
|---|---|---|---|
| 2,096,619 | 10/1937 | Prince | 60/634 |
| 2,436,194 | 2/1948 | Bush | 200/82 B |
| 2,476,024 | 7/1949 | Bush et al. | 200/144 R |
| 2,480,553 | 8/1949 | Cooper et al. | 60/634 |
| 2,485,394 | 10/1949 | Logan | 200/82 B |
| 2,552,358 | 5/1951 | Whitney et al. | 200/148 R |
| 2,578,204 | 12/1951 | Peek | 200/82 B |
| 2,913,559 | 11/1959 | Cromer | 200/82 B |
| 3,210,931 | 10/1965 | Elzufon et al. | 60/634 |
| 3,286,460 | 11/1966 | Stadler et al. | 60/634 |
| 3,384,724 | 5/1968 | Marx et al. | 200/150 R |

*Primary Examiner*—Robert S. Macon
*Attorney, Agent, or Firm*—L. P. Johns

[57] ABSTRACT

A circuit interrupter characterized by a pair of separable contacts, operating means for opening and closing the contacts and comprising a piston for opening the contacts, the piston being operative at a range of 3,000 to 10,000 psi, generating means comprising a solid expulsive charge when ignited for moving the piston to the contact-open position, an igniter for the operating means, a primer for the igniter comprising a mixture of flammable material, means for producing an electric charge in the primer, and spring means for returning the piston to the contact-closed position.

3 Claims, 5 Drawing Figures

CIRCUIT BREAKER OPERATING MECHANISM

This is a continuation of application Ser. No. 762,542, filed Jan. 26, 1977, now abandoned.

BACKGROUND OF THE INVENTION

1. Field of the Invention

This invention relates to a circuit interrupter operating mechanism, and more particularly it pertains to means for rapidly opening the contacts of a circuit interrupter.

2. Description of the Prior Art

Certain types of circuit interrupters, such as the so-called "puffer" circuit breaker, have involved relatively slow contact-opening time periods. Attempts to reduce the opening times have been made with some success. For example, U.S. Pat. Nos. 2,096,619, 2,436,194, 2,476,024, and 2,552,358 disclose typical means for expediting the opening and/or closing of contacts in circuit breakers.

Inasmuch as circuit breakers of this type involve the use of various mechanical linkage systems, it is necessary to initiate movement of the system as soon as possible when an overcurrent occurs. When an overcurrent occurs, most mechanical devices for initiating the opening of contacts have been found unsatisfactory simply due to the time lost in applying forces once the signal to open occurs, i.e., dwell time. Indeed, more recent innovations using electrical primers, although usually faster, still involve an ignition time which is slower than desirable. Thus, the so-called "bridge-wire" type of primer, comprising a resistance wire which ignites a propellant directly involves a relatively slow ignition time of one to three milliseconds. Faster ignition times are desirable in order to open contacts when overcurrents occur.

SUMMARY OF THE INVENTION

It has been found in accordance with this invention that improvements in the ignition time may be obtained by providing a spark-discharge type of ignition mechanism that fires in a relatively short ignition time of about 0.3 milliseconds when used in a circuit interrupter comprising a pair of separable contacts, operating means for opening and closing the contacts and comprising a cylinder and piston mechanism for opening the contacts, generator means for generating a sudden expulsion of gaseous medium against the piston and comprising a solid propellant charge convertible to high pressure gas when ignited, an igniter for the generating means and comprising a flammable material for igniting the generator means, a primer for the igniter comprising a flammable material by an electric charge, means for producing the electric charge in the primer, releasable latch means operatively connected to the operating means for holding the contact in the open position, and closing spring means operatively connected to the cylinder and piston mechanism for returning the piston to a contact-closed position.

The advantage of the circuit interrupter of this invention is that it interrupts circuits using "puffer" type interrupters in less than $1\frac{3}{4}$ cycles or 29.2 milliseconds, thereby providing a superior performance to "puffer" interrupters operated by conventional pneumatic or spring mechanisms.

DESCRIPTION OF THE PREFERRED EMBODIMENT

Figure 1:
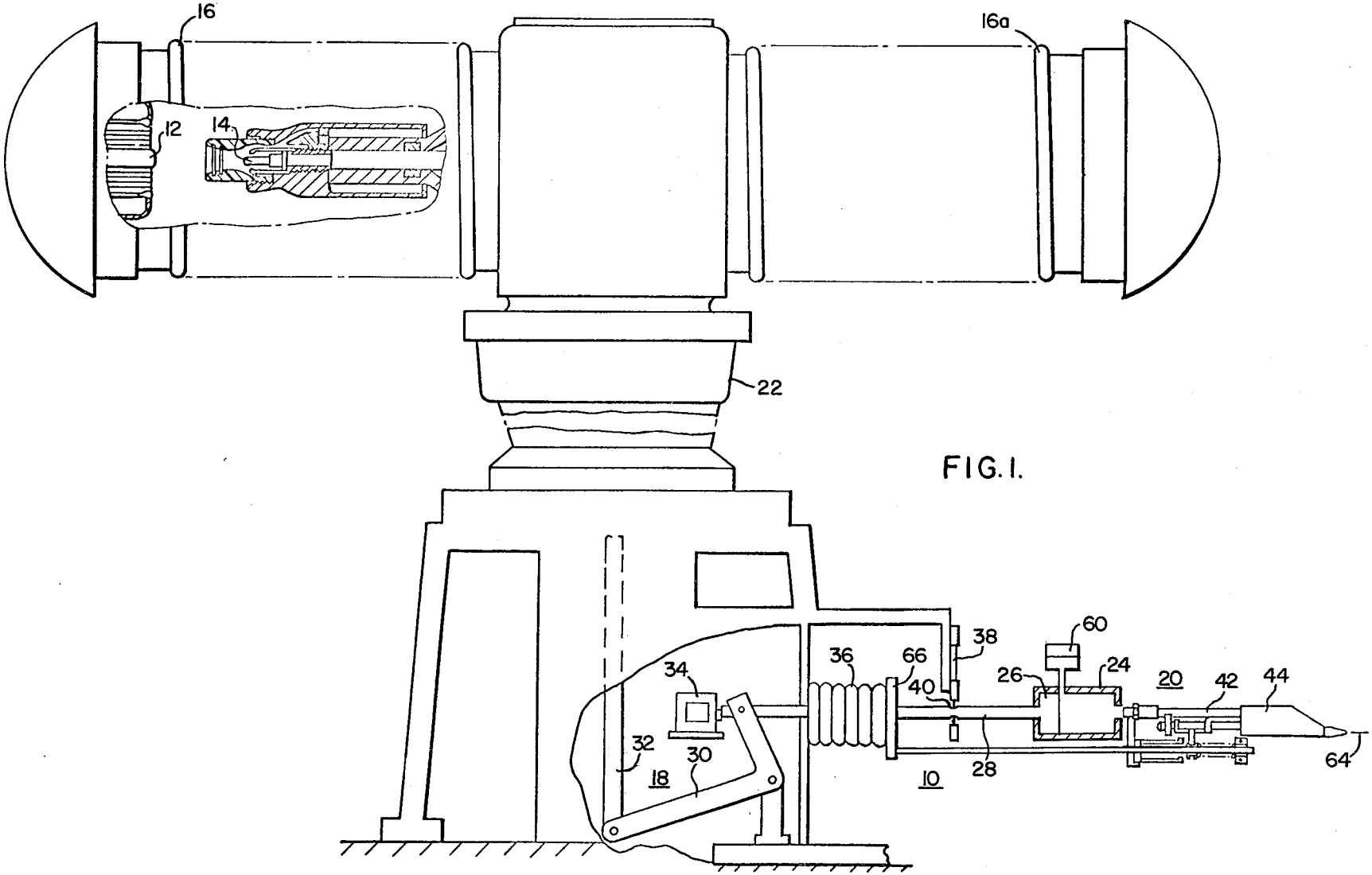
FIG. 1 is a schematic elevational view, partly in section, showing a puffer type circuit interrupter in the open position.

A circuit interrupter of the compressed gas puffer type is generally indicated at 10 in FIG. 1 and it comprises a pair of separable contacts 12, 14 which are contained within an insulating casing 16, operating means 18 for opening and closing the contacts, and means 20 for generating a sudden expulsion of gaseous medium for opening the contacts.

The pair of contacts 12, 14 are similar to corresponding contacts (not shown) in the casing **16*a*. Both casings 16, 16*a* are supported on an upright support 22 of insulating material similar to the casings 16, 16*a***, such as porcelain.

The operating means 18 comprises a cylinder-piston assembly including a cylinder 24, a piston 26, a piston shaft 28, lever means 30, and connecting link 32 for moving the contacts 12, 14 between open and closed positions in a conventional manner.

Figure 2:
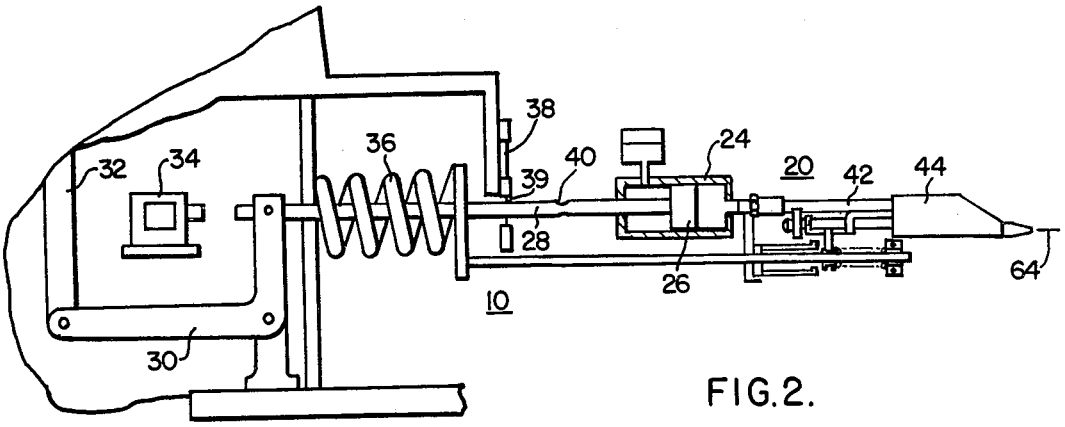
FIG. 2 is a fragmentary sectional view showing the interrupter in the closed position.

Generally, when the piston 26 is moved to the left of the cylinder 24 (FIG. 1), the piston rod 28 rotates the bell crank lever 30 counterclockwise to pull the link 32 down and open the contacts 12, 14. A shock absorber 34 is preferably provided at the left end of the rod 28. Simultaneously, when the rod 28 is driven to the left, a coil spring 36 is compressed. In the compacted position, the spring 36 is ready to close the contacts 12, 14 through the operating means 18 when a closing signal is received. Thus, the spring 36 is charged or compressed during the opening stroke of the piston rod 28 and is used to subsequently close the contacts 12, 14 and return the piston to the right of the cylinder 24. For that purpose, a latch 38 is provided to hold the circuit interrupter 10 in the open position at the completion of the opening stroke. The latch 38 is a mechanism operated either by a solenoid, propellant, or magnetic repulsion coils, which comprises a plunger 39 (FIG. 2) which engages a notch 40 in the piston rod 28. It is noted that the latch may be provided in any other portion of the operating means 18, such as in conjunction with the bell crank lever 30 or the link 32.

Figure 3:
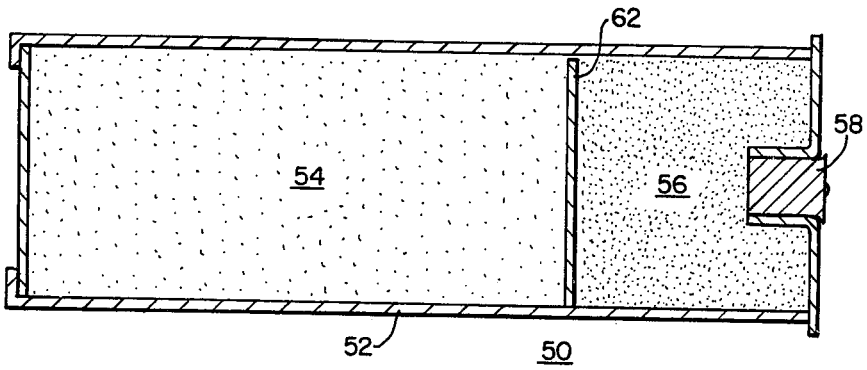
FIG. 3 is a sectional view through a propellant cartridge.

In accordance with this invention, the generator means 20 is a gas generator of a shotgun type comprising a barrel 42 and a receiver or chamber 44. A cartridge load reject assembly 46 comprising a rod 48 is likewise provided to automatically eject and reload cartridges during the closing stroke. A propellant cartridge 50 is generally indicated in FIG. 3. Within the cartridge casing 52 there is a propellant charge 54 of solid expulsive material, a charge 56 of igniter material, and a primer 58. The propellant charge 54 of expulsive material comprises an inflammable material which, upon ignition, is propelled through the barrel into the head of the piston cylinder 24 where it completes combustion to generate gas to drive the piston 26 from the closed position (FIG. 2) to the open position (FIG. 1). An example of the propellant charge 54 is a double base smokeless gunpowder. The expulsive gas may develop a pressure of from about 3,000 to 10,000 psi within the cylinder 24 for driving the piston 26 to open the contacts 12, 14 and to compress the spring 36. A muffler 60 is provided at the end of the piston stroke 26 (FIG. 1) to exhaust the gas.

The igniter charge 56 is preferably separated by a partition 62 from the propellant charge 54 and is a solid charge which produces a flame for igniting the propellant charge 54. The igniter charge 56 is a burnable material, such as black powder, or a mixture of amorphous boron powder and potassium nitrate.

The primer 58 is electrically sensitive to a low level signal or electrical pulse supplied by an ignition line 64 which leads from a means (not shown) for detecting an overcurrent or fault in the circuit of the contacts 12, 14. The primer 58 is preferably comprised of an electrically sensitive, flammable mixture, such as lead styphnate and acetylene black, which ignites when activated by an electric charge to produce a small flame in the igniter charge 56 which, in turn, produces a flame for igniting the propellant charge 54.

In summary, when an electrical or light pulse triggers the firing circuit of the primer 58, the primer is actuated promptly to ignite the igniter charge 56 which in turn ignites the main propellant charge 54. The gas generated by the propellant charge drives the piston 26 through its power stroke. The piston rod 28 is directly coupled to the linkage or operating means 18. As the contacts 12, 14 open, the spring 36 is charged in readiness for closing the contacts subsequently. When the piston 26 nears the end of its stroke, the motion is dampened by the shock absorber 34 and the piston passes an open exhaust port of the muffler 60 to exhaust the gas into the ambient through the muffler. At the full open position, the ball latch 38 which is spring loaded engages the groove or notch 40 on the rod in the open position to hold the circuit breaker in the full open position.

To close the interrupter, a solenoid (not shown) opposing the spring force of the latch 38 is energized and the piston rod 28 is released. As the return spring 36 closes the interrupter, the load-eject mechanism 46 including the rod 48 which extends from a spring backup plate 66 ejects the spent cartridge 50 and loads a new cartridge into the chamber 44. Thus, the circuit interrupter 10 has completed a full open-close cycle and is ready for the next cycle.

Figure 4:
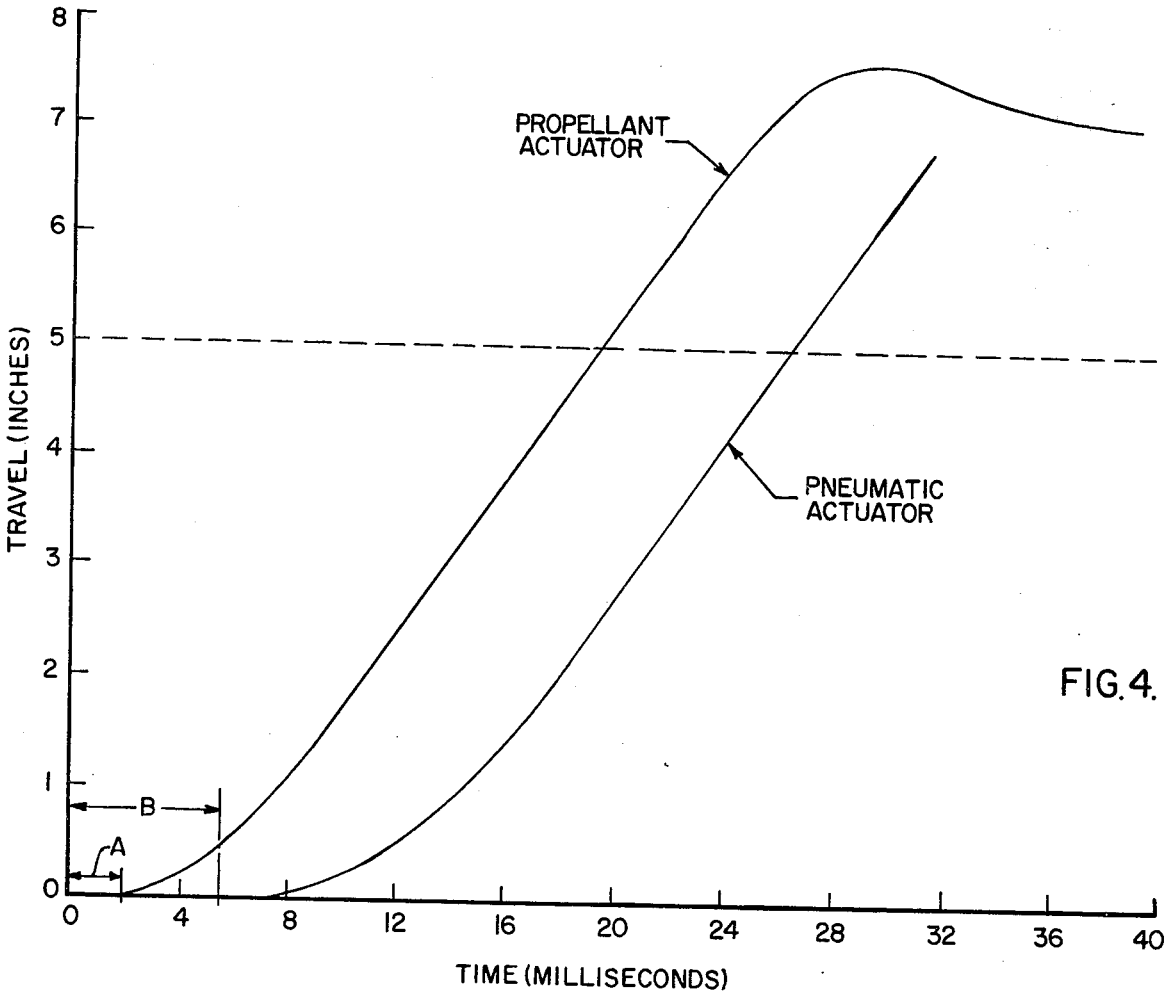
FIG. 4 is a graph of travel vs. time for the travel characteristics of a propellant actuator and a mechanical actuator.

Mechanism tests under puffer load simulation indicate maximum breaker interrupting times of less than $1\frac{3}{4}$ cycles (60 Ht) as a result of an actuator powered by solid propellant. The decrease in operating time is due entirely to a reduction in (1) the dead time, and (2) the characteristic rise of the actuator force. As shown in FIG. 4, the dead time A of the propellant actuator is less than 0.5 milliseconds as compared with 3 milliseconds for a pneumatically operated system. The force rise times are typically 1 millisecond and 4 milliseconds for the propellant and pneumatic actuators, respectively. The travel characteristics of both systems are shown in FIG. 4. There is at least 5.5 milliseconds time difference between the two travel characteristics. Circuit interruption can occur at the first current zero following five inches of travel, which implies the breaker interruption time is equal to the time to reach five inches of travel plus $\frac{1}{2}$ cycle (8.33 milliseconds). Thus, the propellant system can interrupt in 19.6 plus $\frac{1}{2}$ cycle or 27.9 milliseconds. Assuming a relay for providing the signal consumes 1 millisecond, the total interruption time is less than $1\frac{3}{4}$ cycles (29.2 milliseconds).

Figure 5:
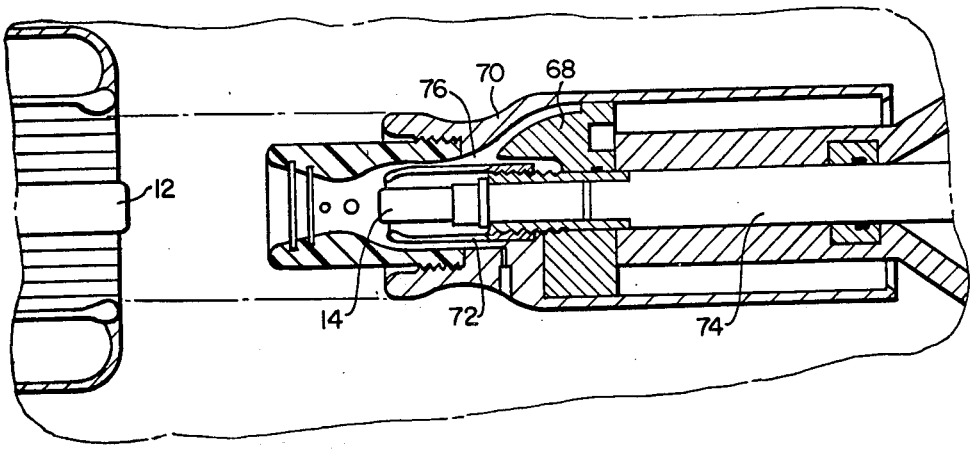
FIG. 5 is an enlarged fragmentary view of the contacts in open position.

The pair of separable contacts 12, 14 contained within the casing 16 are substantially similar to the contact structures disclosed in U.S. Pat. No. 4,101,748. Like the compressed gas puffer type circuit interrupter of that application, the contacts 12, 14 are operatively associated with arc extinguishing structure comprising a gas compressing piston part 68 which is operatively associated with a gas compressing cylinder part 70. The structure also comprises means defining a hollow movable orifice member 72 to assist in directing compressed gas against an arc (not shown) that may develop between the stationary contact 12 and the movable contact 14 when the latter is moved to the open position as shown in FIG. 5. The cylinder part 70, together with the movable contact 14, is mounted on the shaft 74 which is operatively connected to the connecting link 32. Accordingly, when the contact 14 moves to the open position (FIG. 5), a gas within a space 76 between the cylinder and piston parts 68, 70 is compressed and forced into the space between the separating contacts in order to facilitate in extinguishing an arc created during opening of the contacts.

Thus, the propellant-type actuator of this invention not only reduces cost, but improves performance of other power circuit breakers.

What is claimed is:

1. A compressed-gas puffer type circuit interrupter comprising in combination:

(a) means defining a gas-compressing piston part;
(b) means defining a gas-compressing cylinder part;
(c) means defining a relatively stationary contact;
(d) means defining a cooperable relatively-movable contact cooperable with said relatively stationary contact to establish an arc therebetween during the opening operation of the puffer type circuit interrupter;
(e) means defining a hollow movable orifice member to assist in directing compressed gas against said established arc;
(f) means attaching said hollow movable orifice member and also said relatively movable contact with one of said gas-compressing parts;
(g) operating means utilizing explosive detonating means for operating said compressed gas puffer type circuit interrupter and thereby effecting relative motion between said two gas-compressing parts for thereby compressing gas therebetween and thus forcing said compressed gas through said hollow movable orifice and into engagement with the established arc to quickly effect the latter's extinction;
(h) the detonating means comprising a propellant charge of solid expulsive material, a burnable igniter for the charge, a primer for the igniter, and ignition means for producing an electric charge in the primer; and
(i) the ignition means comprising an ignition line for detecting an overcurrent or fault in the circuit of the separable contacts.

2. The compressed-gas puffer-type circuit interrupter of claim 1 in which spring means are provided for returning the piston to a contact-closed position and in which latch means are provided for holding the contacts in the open position.

3. The compressed-gas puffer-type circuit interrupter of claim 2 in which the latch means are releasably connected to the operating means for holding the contacts in the open position.

* * * * *